US005447443A

United States Patent [19]

Ramah

[11] Patent Number: 5,447,443

[45] Date of Patent: Sep. 5, 1995

[54] REVOLVING ELECTRICAL PLUG REMOVAL ACTUATOR

[76] Inventor: Gary J. Ramah, 1618 Beechwood Blvd. #2, Pittsburgh, Pa. 15217

[21] Appl. No.: 246,774

[22] Filed: May 20, 1994

[51] Int. Cl.[6] ..... H01R 13/62

[52] U.S. Cl. ..... 439/160; 439/159

[58] Field of Search ..... 439/351, 352, 353, 310–320, 439/180, 321, 152–160

[56] References Cited

U.S. PATENT DOCUMENTS 2,161,353 6/1939 Hummel ..... 439/160

2,551,533 5/1951 Gernhevser ..... 439/159

5,171,291 12/1992 d'Alayer de Costemore d'Arc et al. ..... 439/152

*Primary Examiner*—David L. Pirlot

[57] ABSTRACT

A revolving actuator, that resides between an existing electrical plug and an existing electrical outlet, removes the plug from the outlet upon axial movement of the actuator. This actuator converts the manual twisting force, applied to several gripping surfaces, into a pushing force by wedging itself between the plug and outlet and gradually forcing the plug in an axial direction away from the outlet.

3 Claims, 1 Drawing Sheet

REVOLVING ELECTRICAL PLUG REMOVAL ACTUATOR

BACKGROUND OF THE INVENTION

1. Field of the Invention

This invention relates to electrical appliance plugs and, more particularly, to ultra safe rotatable electrical plug removal mechanisms for disconnecting electrical appliances from electrical wall outlets. As herein disclosed, a outlet refers to an element which generally comprises the "female" portion of a connector. A plug refers to an element which generally comprises the "male" portion of a connector. An outlet includes permanently powered contacts which are fixed to a wall, and the plug includes axially extending prongs which are, electrically connected to an appliance and inserted into the outlet to power the appliance.

The sides of most electrical plugs do not offer much surface for a user to grip, therefore a great deal of finger strength is required to hold the electrical plug in order to remove it from it's associated outlet. Moreover, as the plug is withdrawn there is a tendency to increase one's grip on the plug body by inserting the, fingers into the widening gap between the plug and the outlet. Since the electrical prongs in the plug are still powered, until the plug is fully withdrawn, contact with the exposed prongs can result in dangerous shocks. Furthermore, to avoid such hazards, the person, using the electrical appliance, will give the electrical cord a sharp pull to accomplish the disconnection which frequently breaks or weakens the connection between the plug and the cord.

2. Description of the Prior Art

It has been recognized that electrical appliance plug removal aids are useful when the fit between the plug and the outlet is relatively tight. Example aids to facilitate plug removal are shown in U.S. Pat. Nos.: 2,161,353, 2,551,382 and 5,171,291.

The device of my invention is intended to obtain the same ultimate result as the devices shown in the patents, but has a structural arrangement significantly different from the arrangements of the noted patents and from this obtains several advantages. These advantages will be described in connection with the description of the device on this invention.

SUMMARY OF THE INVENTION

Electrical plugs, although easy to insert into a standard socket are by contrast difficult to remove from such a socket. The only method currently available to the user is to grasp the plug by it's end and pull it from the socket. The gripping surface of the plug is relatively limited and the plug provides little support to enable the user to apply a force sufficient to remove the plug from the socket. This removal procedure can be very difficult for older individuals.

There is also a tendency to insert one's finger's into the widening gap between the plug and it's associated outlet, to increase the gripping surface contact, as the plug is withdrawn. This creates the danger of the user's fingers contacting the metal plug prongs while the plug is still powered by the socket. Contact with these exposed prongs can result in dangerous shock or electrocution.

The object of the invention is to provide the gradual and smooth detachment of the plug from it's outlet without the necessity of exerting undue strain on the connection, and avoid the danger of causing short circuits and injury to persons. A further objective of my invention is the provision of an aid composed of the least possible number of parts molded from a suitable insulating material. A still further objective of my invention is the removal of an electrical plug from it's socket with a revolving actuator co-operating with the existing plug body and the existing socket to effect the removal of the plug from the socket by developing a pushing force between the existing plug body and it's associated outlet.

The present invention achieves the above mentioned objects by providing a simple, reliable, and economical removing mechanism for electrical plugs. Removing mechanisms constructed according to the invention reside between the existing plug and outlet and require no fundamental and costly modification. The removing mechanism can easily work with existing plugs and outlets, and uses standard components which have already been approved by the various safety and/or standards organizations—avoiding unnecessary administrative approval procedures.

The revolving actuator of this invention counterbalances the forces between the plug and the outlet. This counterbalance insures that neither the plug nor the outlet can be damaged. The removing mechanism can be easily used and operated when plugs are inserted side by side on multi-socket outlets.

BRIEF DESCRIPTION OF THE DRAWINGS

A complete understanding of the present invention may be gained by considering the following detailed description in conjunction with the accompanying drawings, in which.

To facilitate reader understanding, identical reference numerals are used to designate elements common to the figures.

DETAILED DESCRIPTION

Figure 1:
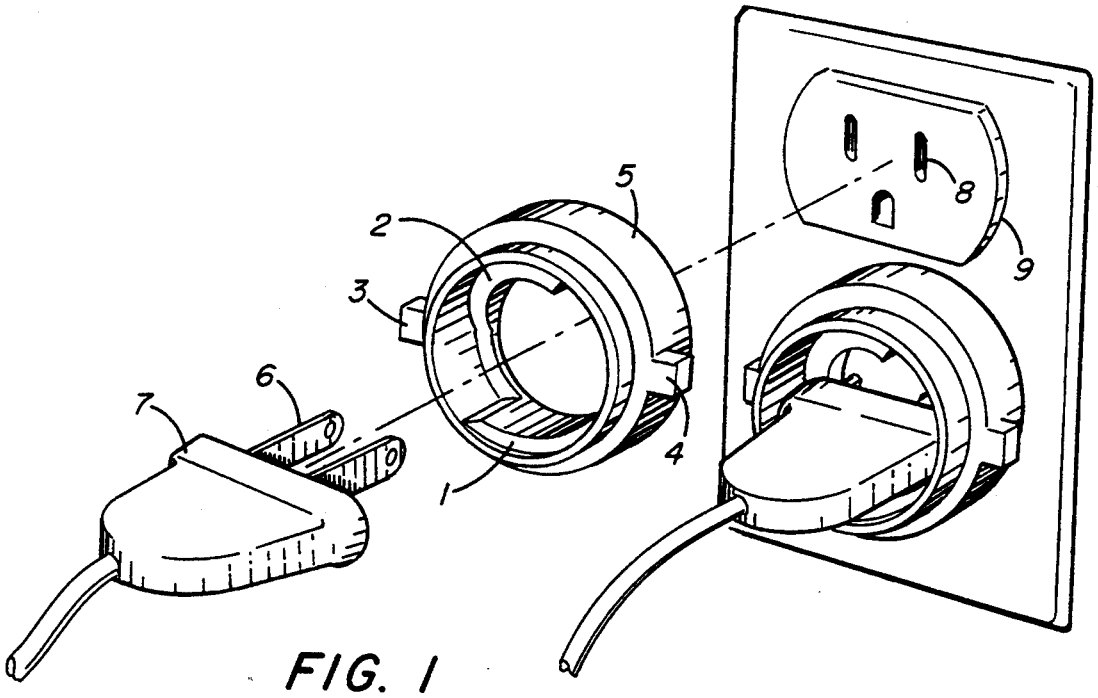
FIG. 1 shows a perspective view of two electrical plugs, their associated outlets and my invention residing between each plug and it's outlet.
Figure 2:
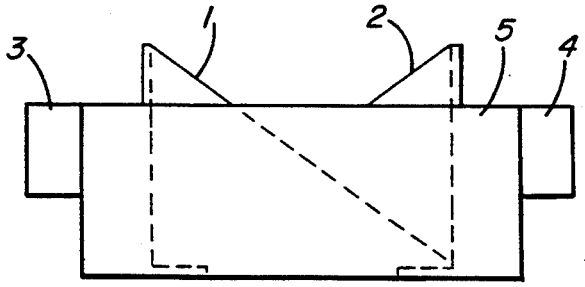
FIG. 2 shows a vertical section through my invention clearly showing the ramps, gripping surfaces and the safety skirt.

In FIG. 1 there is shown a perspective view of a revolving actuator in accordance with the present invention comprising two ramps 1 and 2, gripping surfaces 3 and 4, and a safety skirt 5 which provides coverage of the "live" prongs to prevent the inadvertent insertion of objects into the widening gap between the plug and it's associated outlet during removal.

This invention consists of a revolving actuator which closely fits around an electrical plug's prongs 6. This member consists of two ramps 1 and 2 that cooperate with the existing plug body 7. These ramps 1 and 2 are arranged so that a manual force applied to rotate the member is converted into a axial force that pushes the plug away from the outlet. When the revolving actuator is rotated by the user's twisting motion applied to the gripping surfaces 3 and 4 this rotational force is converted by the ramps 1 and 2 to an axial force pushing between the plug body 7 and the outlet 9 to remove the plug. This mechanism does not require special cooperating profiles on the plug body 7.

As illustrated in FIG. 1, the revolving actuator is located between the plug and the outlet allowing some of the plug body to reside within the revolving actuator. Due to the plug prongs 7 being connected to the outlet coupling elements 8 the plug body cannot turn. Therefore, by grasping the gripping surfaces 3 and 4 and manually twisting the actuator, it's ramps 1 and 2 will develop a force between the plug body 7 and the outlet 9. This turning effort will produce the required longitudinal sliding movement and will detach the plug connector prongs 6 from the circuit coupling elements of the outlet 8 by pushing the plug away from the socket. The plug body 7 riding the actuator ramps 1 and 2 will gradually produce a pushing effect to push out the plug smoothly out of it's socket so that no undue strain will be exerted on the connections and the danger of short circuit will be avoided.

The invention provides an electrical disconnection device with means of disconnecting a plug from it's outlet by a turning operation instead of a pulling operation. Instead of a user pulling the plug to remove it from the outlet, the user rotates or "twists" the member which causes a pushing force to be applied between the plug and the outlet.

It will be understood that I have described the preferred form of my invention only, and that I may make such changes in it's construction as come within the scope of the appended claims without departing from the spirit of the invention.

I claim:

1. An electrical-plug-removing mechanism being received over a standard outlet plug comprising:

a revolving actuator that resides between an existing plug and an existing outlet, said revolving actuator including:

multiple ramps that convert a manual force applied to rotate said revolving actuator, around an existing plug mating face, into a pushing force applied between the existing plug and the existing outlet thereby moving the plug away from the outlet in a co-operative fashion by engagement with only the existing plug mating face.

2. An electrical-plug-removing mechanism according to claim 1 wherein said revolving actuator includes a safety skirt that surrounds the ramps and covers prongs of the plug during plug removal.

3. An electrical-plug-removing mechanism according to claim 2 wherein said revolving actuator has multiple grip positions that provide a gripping surface to achieve the manual rotation of said revolving actuator with a minimal amount of force.

* * * * *